US012546193B1

(12) United States Patent
Parks et al.

(10) Patent No.: US 12,546,193 B1
(45) Date of Patent: Feb. 10, 2026

(54) PERFORATING GUN AND SYSTEM HAVING CONFIGURABLE ORIENTATION

(71) Applicant: SWM International, LLC, Pampa, TX (US)

(72) Inventors: David C. Parks, Calgary (CA); Dan S. Ang, Keller, TX (US)

(73) Assignee: SWM International, LLC, Pampa, TX (US)

( * ) Notice: Subject to any disclaimer, the term of this patent is extended or adjusted under 35 U.S.C. 154(b) by 58 days.

(21) Appl. No.: 18/130,823

(22) Filed: Apr. 4, 2023

(51) Int. Cl.
*E21B 43/117* (2006.01)
*E21B 43/119* (2006.01)

(52) U.S. Cl.
CPC ..... *E21B 43/117* (2013.01); *E21B 43/119* (2013.01)

(58) Field of Classification Search
CPC ..... E21B 43/117; E21B 43/119
See application file for complete search history.

(56) References Cited

U.S. PATENT DOCUMENTS

| | | | | |
|---|---|---|---|---|
| 7,278,491 | B2 | 10/2007 | Scott | |
| 9,115,572 | B1 | 8/2015 | Hardesty et al. | |
| 9,382,783 | B2 | 7/2016 | Langford et al. | |
| 9,494,021 | B2 | 11/2016 | Parks et al. | |
| 10,352,136 | B2 | 7/2019 | Goyeneche | |
| 10,975,671 | B2 | 4/2021 | Bradley et al. | |
| D921,858 | S | 6/2021 | Eitschberger et al. | |
| 11,391,127 | B1 | 7/2022 | Hoelscher et al. | |
| 11,492,854 | B2 | 11/2022 | Langford et al. | |
| 11,867,032 | B1 * | 1/2024 | Parks | E21B 43/1185 |
| 2017/0211363 | A1 * | 7/2017 | Bradley | F42B 5/035 |
| 2020/0308938 | A1 | 10/2020 | Sullivan et al. | |
| 2021/0301599 | A1 * | 9/2021 | Mulhern | E21B 17/028 |
| 2022/0307330 | A1 * | 9/2022 | Eitschberger | E21B 17/028 |
| 2023/0016759 | A1 | 1/2023 | Eitschberger et al. | |

FOREIGN PATENT DOCUMENTS

| | | |
|---|---|---|
| CN | 201031674 | 3/2008 |
| WO | 2021116338 A1 | 6/2021 |
| WO | 2022084363 A1 | 4/2022 |
| WO | 2022146454 | 7/2022 |

OTHER PUBLICATIONS

Halliburton, "Halliburton Velocity(TM) Aligned Gun System," Brochure, copyright 2023, dated Feb. 2023, 2-pgs.
Owen Oil Tools, "Subs for Expendable Retrievable Guns," Brochure copyright 2007, last revised Jul. 2004, 2-pgs.

* cited by examiner

*Primary Examiner* — Nicole Coy
*Assistant Examiner* — Jennifer A Railey
(74) *Attorney, Agent, or Firm* — Cabello Hall Zinda, PLLC

(57) ABSTRACT

A perforating gun includes a charge holder that is positioned in a housing. End fittings are affixed to the ends of the holder and support the holder in the housing. Both end fittings have electrical conductors disposed therethrough. One end fitting has two supports. A first support is affixed to the holder's end and has a mating surface. A second support is disposed adjacent to the first support and has another mating surface. The second support is configured to support the holder's end in the housing. The mating surfaces of the supports have mating features configured to mate at different radial orientations relative to one another. This allows the orientation of the holder and its charge(s) to be adjusted inside the housing when the gun is connected to other components of a gun string.

20 Claims, 7 Drawing Sheets

PERFORATING GUN AND SYSTEM HAVING CONFIGURABLE ORIENTATION

FIELD OF THE DISCLOSURE

The present disclosure relates generally to downhole perforating gun systems, and more particularly to manufacture, assembly, and methods of operation for a perforating gun and associated system.

BACKGROUND OF THE DISCLOSURE

In a conventional oil and gas well, the wellbore is cased and cemented to isolate the wellbore from the surrounding formation, which contains the reservoir fluids of interest. To begin production, the casing and cement are perforated at desired depths to provide a flow path for the oil and gas. After perforating, hydraulic stimulation and fracturing operations can be performed.

A perforating gun is a device used to perforate the casing and the cement in the wellbore. The perforating gun contains explosive shaped charges that produce the perforations in the casing and cement when detonated. A conventional perforating gun includes an outer gun carrier containing the explosive charges, which can shoot radially outward when detonated. Typically, multiple perforating guns are connected together to form a perforating gun string, which is conveyed downhole in the casing using a wireline or a tubing string.

When making the perforations, the shaped charges are detonated at selected depths in the wellbore. In addition to selected depths, the shaped charges can preferably be detonated in desired directions (e.g., angle relative to horizontal) to produce the perforations in the casing. For example, the perforations can preferably be oriented in a direction of maximum principal stress or a preferred fracture plane (PFP) of the formation so hydraulic fracturing operations can be more successful.

For this reason, operators are interested in various ways to orient the perforating guns in the wellbore so the shaped charges can be detonated toward desired directions. For example, operators may use various types of orienting features on the gun string to encourage a particular placement of the guns. Additionally, operators may want to orient the shaped charges in one gun to have a particular orientation relative to the shaped charges in an adjacent gun on the gun string. Usually, the orientation features are used to align multiple guns so the guns consistently shoot in the same direction, with consistent distance from the casing, and at consistent thickness of cement to achieve the most consistent hole size. This makes hydraulic fracturing more effective because each of the perforations can be equally fractured.

To adjust the orientation of the guns, operators assemble the gun string at surface so that the shaped charges are arranged at particular orientations relative to one another along the length of the gun string. Typically, a threaded collar or locking ring has been used to lock the radial orientation of a gun's housing relative to a tandem sub used to connect the adjacent guns together. The gun's housing is threaded on the tandem sub to have a desired orientation relative to an adjacent gun, and a lock ring on the tandem sub is threaded against the gun's housing to lock the housing in place. Using the locking rings, the adjacent guns on the gun string can be aligned and rotationally locked together prior to running. This technique allows the orientation of the shaped charges to be adjusted from one gun relative to another as desired.

Unfortunately, using locking rings on tandem subs is not the most effect way to orient and rotationally lock guns together. The locking rings may loosen, and the arrangement can create issues with sealing between the tandem subs and the guns' housings. These and other issues may arise. Finally, other techniques currently used for orienting perforating guns on a gun string may be complex and may be time-consuming to assemble.

The subject matter of the present disclosure is directed to overcoming, or at least reducing the effects of, one or more of the problems set forth above.

SUMMARY OF THE DISCLOSURE

A perforating gun disclosed herein comprises a housing, a charge holder, a first end fitting, and a second end fitting. The housing defines an internal passage therethrough. The charge holder has first and second ends and has one or more charge receptacles for shaped charges. The charge holder is configured to position in the internal passage of the housing. The first end fitting is disposed on the first end of the charge holder and is configured to support the first end of the charge holder in the internal passage of the housing. The first end fitting has a first electrical conductor disposed therethrough. The second end fitting has first and second supports, and the second end fitting has a second electrical conductor disposed therethrough. The first support is disposed on the second end of the charge holder and has a first mating surface. The second support is disposed adjacent to the first support and has a second mating surface. The second support is configured to fit in a set radial orientation relative to the housing, and the second support is configured to support the second end of the charge holder in the internal passage of the housing. The first and second mating surfaces have a mating feature configured to mate the first and second mating surfaces at different radial orientations relative to one another.

A system disclosed herein comprised a plurality of such perforating guns interconnected together. The perforating gun can connect in line together using tandem subcomponents that interconnect the housings together. The orientation of the charge holders and the resulting direction of the shaped charges in the receptacles of the charge holder can be adjusted relative to one another between the guns along the gun string by adjusting the different radial orientations of the first and second supports on the second end fittings of the guns.

A method is disclosed herein to assemble a perforating gun for use on a gun string. The method comprises, not necessarily in sequence: supporting a first end of a charge holder in an internal passage of a housing using a first end fitting disposed on the first end of the charge holder; providing a first electrical connection into the housing via a first conductor disposed on the first end fitting; supporting a second end of the charge holder in the internal passage of the housing using a second end fitting having first and second supports, the first support disposed on the second end of the charge holder, the second support disposed adjacent to the first support and being configured to engage in a set radial orientation in the internal passage; providing a second electrical connection into the housing via a second conductor disposed on the second end fitting; providing a ground connection into the housing via a ground conductor disposed on the second end fitting; adjusting a radial orientation of the charge holder relative to the set radial orientation of the second support by rotating the first support relative to the second support; and fixing the adjusted radial orientation of the charge holder by mating the first and second supports together.

DETAILED DESCRIPTION OF THE DISCLOSURE

Figure 1A:
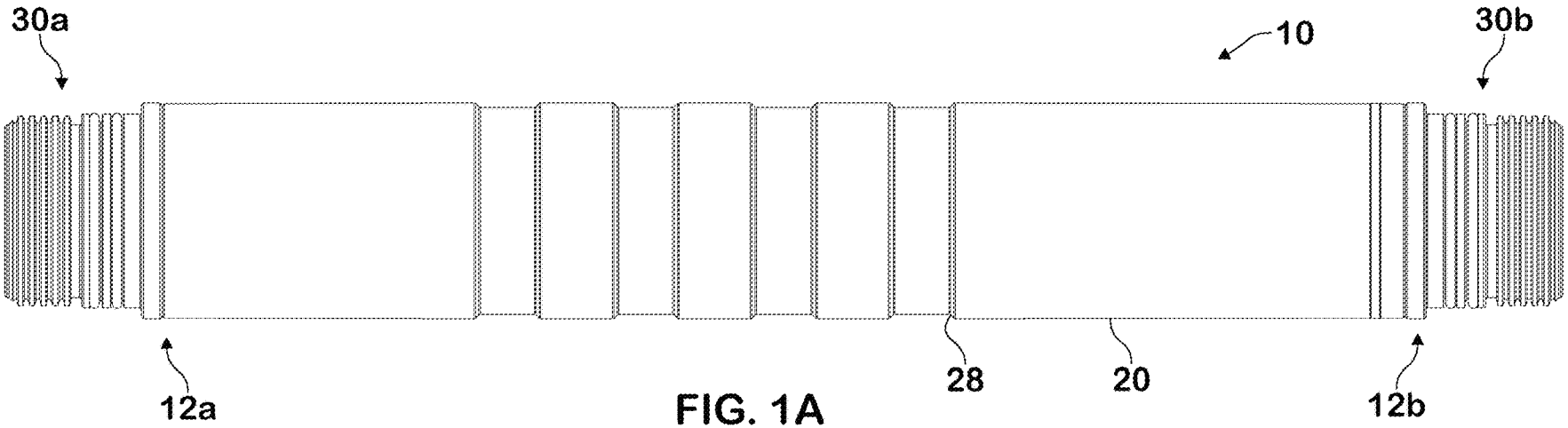
FIG. 1A illustrates an elevational view of a first embodiment of a perforating gun according to the present disclosure.
Figure 1B:
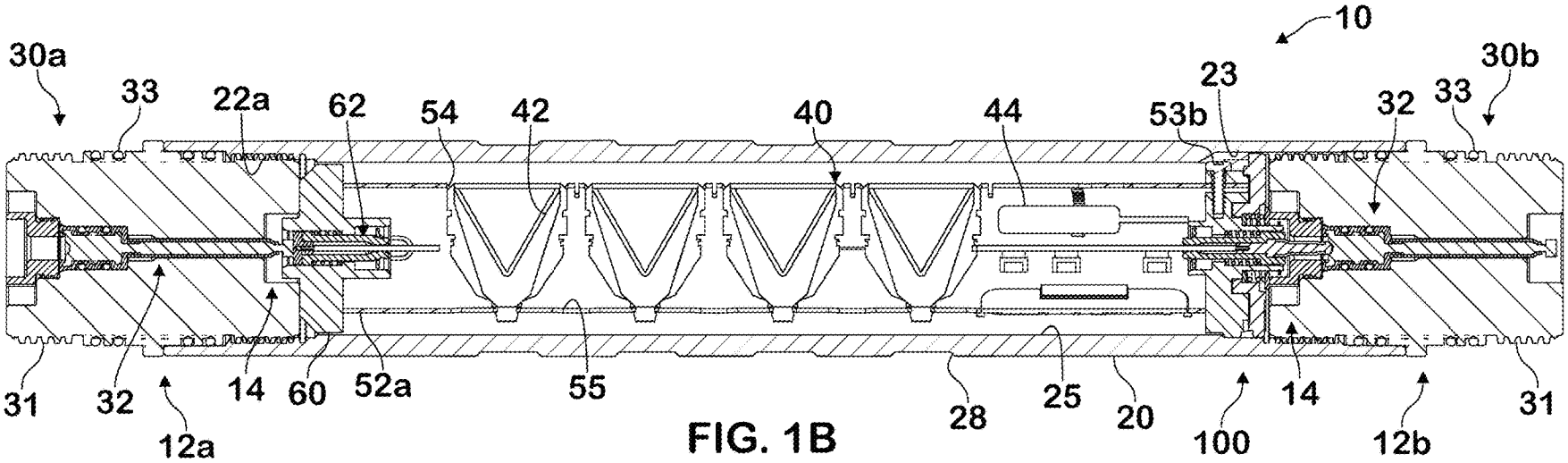
FIG. 1B illustrates a cross-sectional view of the disclosed perforating gun.

FIG. 1A illustrates an elevational view of a first embodiment of a perforating gun 10 according to the present disclosure, and FIG. 1B illustrates a cross-sectional view of the disclosed perforating gun 10. As will be appreciated, the perforating gun 10 can be used on a perforating gun string in which the perforating gun 10 is interconnected to other perforating guns or components. In the present example, intermediate (a.k.a. tandem or reusable) subcomponents 30*a-b* are used to connect the perforating gun 10 to other perforating guns or components on the gun string. As discussed below, other configurations are possible in which the subcomponents 30*a-b* are not used.

The perforating gun 10 has an upper or uphole end 12*a* and has a lower or downhole end 12*b*. As will be appreciated, the terms uphole and downhole simply refer to the way the gun 10 is assembled and deployed in a wellbore. In general, the perforating gun 10 includes (i) an outer body or housing 20 having an internal passage or bore 25 extending axially therethrough, (ii) an inner charge assembly 40 configured to carry one or more explosive elements (e.g., shaped charges) 42, and (iii) one or more detonators (not shown) for igniting the shaped charges 42 as desired, such as through one or more detonation cords (not shown). The detonator (not shown) of the perforating gun 10 can be actuated by a dedicated controller or switch assembly 44, which may include one or more printed circuit boards (PCB) configured to provide electrical signals to the detonator (not shown) to set off the shaped charges 42. Details related to a switch assembly, detonator, detonator chord, and the like can be found in U.S. application Ser. No. 17/831,900 filed Jun. 3, 2022 and U.S. application Ser. No. 16/293,508 filed Mar. 5, 2019, which are incorporated herein by reference.

Electric current is normally provided downhole to the gun string from the surface, such as via a wireline. The electric current is then provided to each gun's associated switch assembly 44 and detonator (not shown). The electric current can also be further provided through each perforating gun 10 of the gun string to the next successive downhole perforating gun 10 (or other tool or component), if any, on the gun string. To pass the electric current between components, the perforating gun 10 uses multiple conductive electrical components in the gun string at various conductive interfaces 14 formed therebetween. For example, electric current is typically provided to each switch assembly 44 via one or more inner body conductors associated with the charge assembly 40. Various wires or inner conductors connect to and connect from the switch assembly 44 for the electrical control of the perforating gun 10. Electric current is then typically provided to the next successive downhole perforating gun 10 via a feedthrough at the conductive interfaces 14.

Preferably, the conductive interfaces 14 established between the perforating guns 10 for the electric current flow path is non-wired. In fact, the entire perforating gun 10 may be wire-free, which can eliminate the need for connecting or soldering wires. In particular, one or more pairs of non-wired electrical components abut one another to form the desired conductive interfaces 14 with the perforating gun 10. These components have non-wired, plug-jack, ball-socket, or biased electrical connections or any other suitable arrangement of parts to create one or more non-wired interfaces 14.

Figure 2:
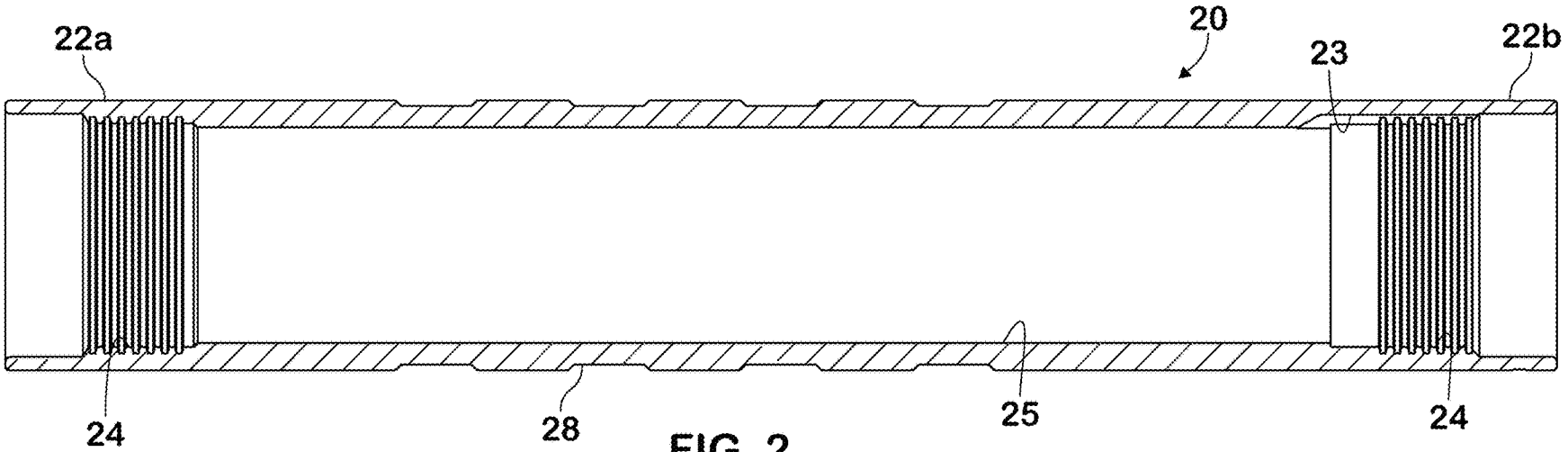
FIG. 2 illustrates a cross-sectional view of a housing for the disclosed perforating gun.

As noted, the perforating gun 10 includes an outer body or housing 20, which can be a tube, having the inner passage 25 in which the charge assembly 40 is supported. (FIG. 2 illustrates an isolated cross-sectional view of the housing 20 for further reference). The housing 20 can be composed of a suitable material, such as a metal material for use downhole. Internal thread 24 is defined in the internal passage 25 toward the uphole and downhole ends 22*a-b* of the housing 20. The thread 24 is used for connecting the perforating gun 10 to other components, such as connecting to tandem subcomponents 30*a-b*, other perforating guns, and the like of a gun string. As noted, the perforating gun 10 in the present embodiment uses the intermediate subcomponents 30*a-b* to connect the perforating gun 10 to other guns or components of a gun string. Therefore, the housing thread 24 threads onto the subcomponents 30*a-b*. As shown, the subcomponents 30*a-b* include thread 31 and seals 33 for the connection with the housing 20.

Figure 3:
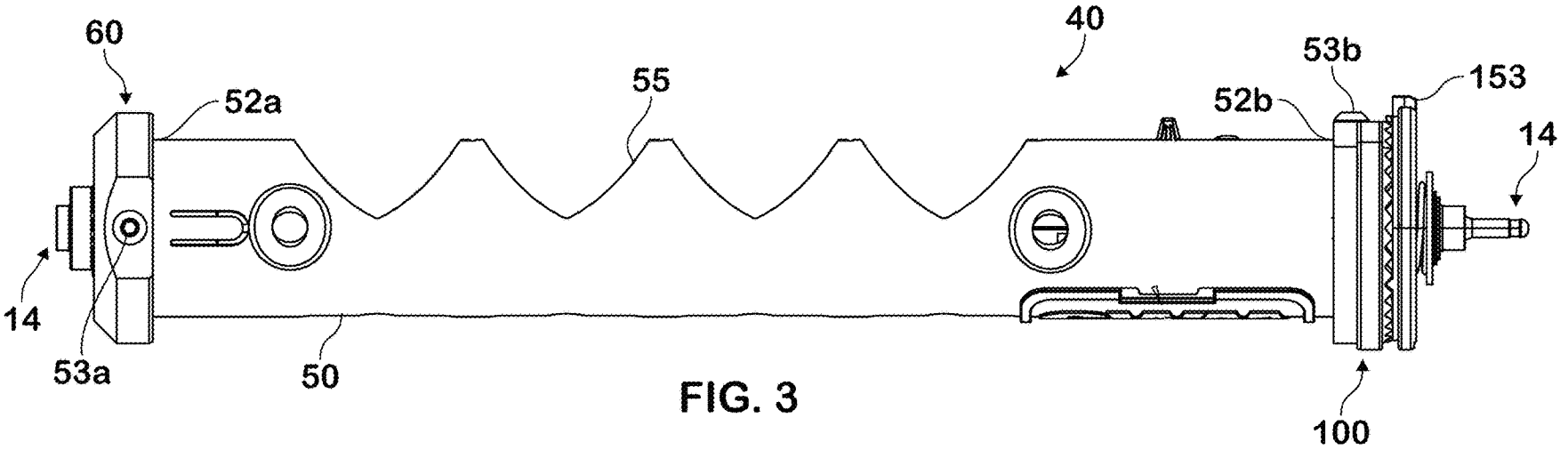
FIG. 3 illustrates an elevational view of an internal charge assembly for the disclosed perforating gun.

The charge assembly 40 mounted inside the internal passage 25 of the housing 20 includes a charge holder 50 and end fittings 60, 100. (FIG. 3 illustrates an isolated view of the internal charge assembly 40 for further reference.) The charge holder 50 is configured to position in the internal passage 25 of the housing 20 and is supported by the end fittings 60, 100.

The charge holder 50 can be tubular as shown or can have other shapes. The charge holder 50 can be composed of any suitable material, such as a metal or plastic material. The charge holder 50 has first and second ends 52*a-b* and has one or more charge receptacles 54. As shown in FIG. 1B, the charge receptacles 54 are configured to support explosive shaped charges 42.

The shaped charges 42 supported in the charge holder 50 are oriented outward toward the surface of the housing 20's inner passage 25. In this example, four cutouts for the receptacles 54 are formed along the same side of the charge holder 50 to accommodate a set of four shaped charges 42. The shaped charges 42 are disposed in line with one another so the shaped charges 42 are oriented in the same direction. As will be appreciated, more or fewer receptacles 54 and shaped charges 42 can be provided, depending on the length of the perforating gun 10 and the size of the shaped charges 42. Additionally, the receptacles 54 and the shaped charges 42 can be oriented in one or more orientations relative to one another.

As shown in FIGS. 1A-1B and 2, the housing 20 includes one or more circumferential scallops 28 at axial locations on the housing 20 where the one or more shaped charges (42) are supported in the receptacles 54. These circumferential scallops 28 constitute a thinning of the sidewall of the housing 20 where the explosive shaped charge 42 emanates when exploded. These circumferential scallops 28 can preferably be defined on the outside surface of the housing 20 as shown. They also preferably extend around the entire circumference of the housing 20 because the radial orientation of the shaped charges 42 and the charge holder 50 can be adjusted inside the housing 20 using the second (downhole) end fitting 100 as discussed below.

As shown in FIG. 1B, the first end fitting 60 is disposed on the first end 52*a* of the charge holder 50 and is configured to support the first end 52*a* of the charge holder 50 in the internal passage 25 of the housing 20. For example, at least one first fixture 53*a*, such as a bolt or a screw, can affix the first end 52*a* of the charge holder 50 to the first end fitting 60. A similar arrangement can be used for the holder's second end 52*b*. For example, a bolt, screw, or other fixture 53*b* disposed through the second end 52*b* of the charge holder 50 can affix to the edge 112 of the inner support 110.

This first end fitting 60 is an uphole end fitting for use on the uphole end 52*a*. The uphole end fitting 60 has a circumferential edge that engages inside the housing 20's inner passage 25. In general, the uphole end fitting 60 can be set at any desired radial orientation inside the housing 20's inner passage 25.

The uphole end fitting 60 can be composed of a suitable material. For example, the uphole end fitting 60 can be composed of a non-conductive material, such as a thermoplastic material.

The uphole end fitting 60 includes a first electrical conductor 62 disposed therethrough. Being part of the conductive interface 14, the first electrical conductor 62 provides an electrical connection from inside the perforating gun 10 to the subcomponent's intermediate conductor 32, which in turn provides an electrical connection to another gun or another component of a gun assembly.

Figure 4:
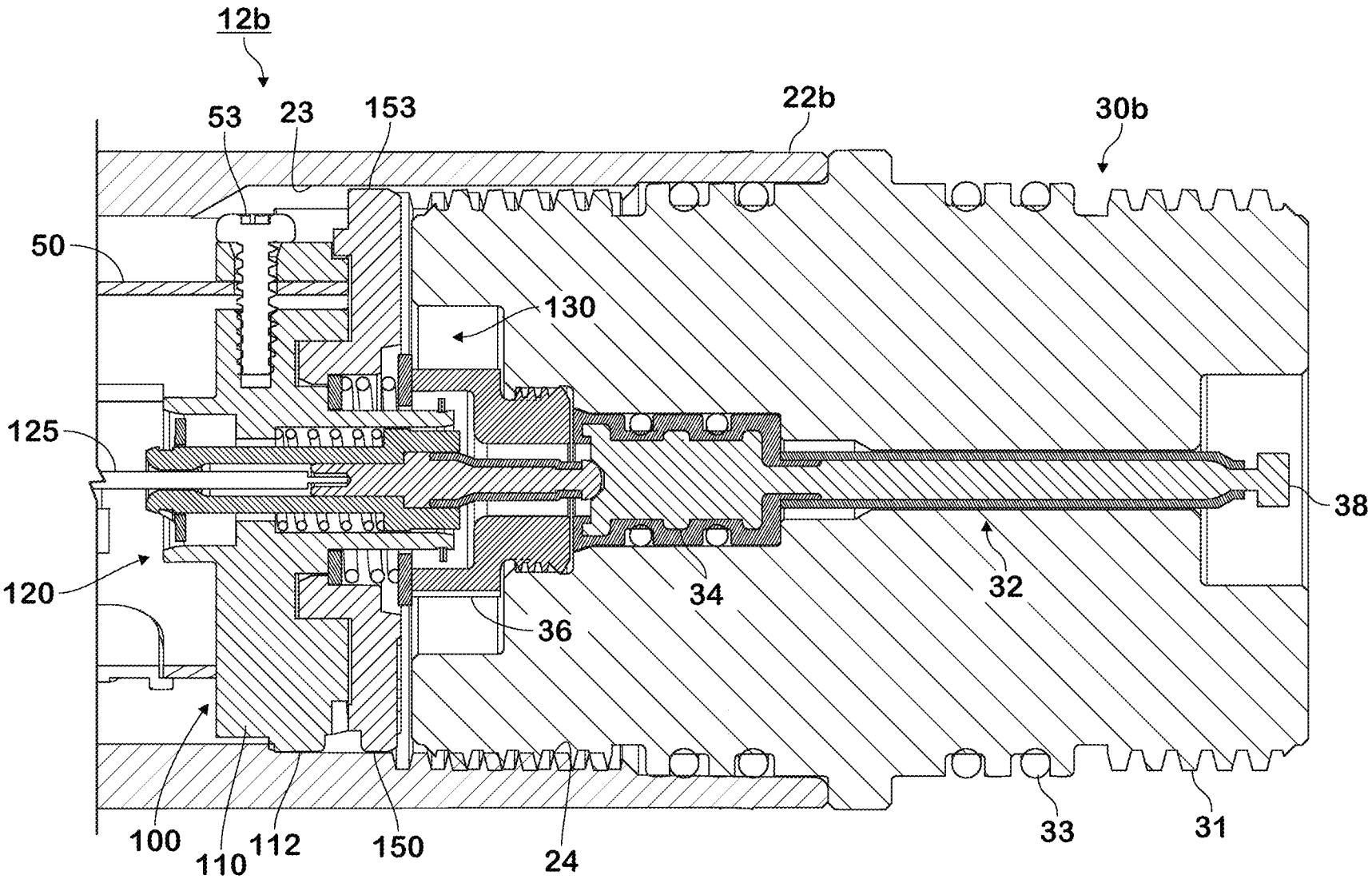
FIG. 4 illustrates a detailed cross-sectional view of a downhole end of the disclosed perforating gun.

The second end fitting 100 is a downhole end fitting for use on the downhole end 52*b*. Like the uphole end fitting 60, the downhole end fitting 100 can be composed of a suitable material, such as a thermoplastic. (For further reference, FIG. 4 illustrates a detailed cross-sectional view of the downhole end 12*b* of the disclosed perforating gun 10 having the downhole end fitting 100.) The downhole end fitting 100 also has a circumferential edge that engages inside the housing 20's inner passage 25.

The downhole end fitting 100 also has a second electrical conductor 120 disposed therethrough. Being part of the conductive interface 14, the second electrical conductor 120 also provides an electrical connection from inside the perforating gun 10 to the subcomponent's intermediate conductor 32, which in turn provides an electrical connection to another gun or another component of a gun string.

In general, the downhole end fitting 100 fits in a set, fixed, or predetermined radial condition inside the housing 20's inner passage 25. For example, the internal passage 25 of the housing 20 has at least one location 23, and the downhole end fitting 100 has at least one locator 153 configured to locate at least one location 23 of the internal passage 25. For example, the at least one location 23 can include a slot defined in the internal passage 25, and the at least one locator 153 can include a tab protruding from the edge of the downhole end fitting 100 and configured to position in the slot 23.

Although the downhole end fitting 100 fits in the set radial orientation using the slot 23 and tab 153, the downhole end fitting 100 allows the charge holder 50 to be adjusted and locked in a desired radial orientation about the longitudinal axis of the perforating gun 10 so that the direction of the one or more charges 42 can be set at a particular radial orientation relative to the housing 20. In other words, the shaped charges 42 can be set at a desired radial orientation relative to the housing's threads 24, which defines how the housing 20 affixes relative to other perforating guns using the subcomponents 30*a-b*.

The downhole end fitting 100 as shown in FIG. 4 includes a first support 110 and a second support 150 that are mated together to lock their radial orientation. The first support 110 is an "inner" support and is affixed to the downhole end 52*b* of the charge holder 50 using a fastener 53*b* or the like. The first support 110 has an outer edge 112 that can rest inside the housing's passage 25 at any particular radial orientation.

The second support 150 is an "outer" support and is a separate component from the inner support 110. The outer support 150 also has an outer edge 152 that can rest inside the housing's passage 25. However, the second support 150 has a tab 153 that fits into a slot 23 of the housing's passage 25 so the outer support 150 fits in a set, fixed, or predetermined radial orientation in the passage 25. For assembly of the perforating gun 10, the inner support 110 and connected charge holder 50 can have its radial orientation rotated relative to the set radial orientation between the outer support 150 and the surrounding housing 20 to adjust the relative orientation of the shaped charges (42). Meanwhile, the interface of mating surfaces between these supports 110, 150 locks their radial orientation in place.

Finally as shown in FIG. 4, the electrical conductor 120 of the downhole end fitting 100 makes an electrical connection with the feedthrough conductor 32 on the connected subcomponent 30*b*. Meanwhile, a ground conductor 130 on the end fitting 100 makes an electrical ground connection with a ground ring 36 of the connected subcomponent 30*b*. The feedthrough conductor 32 is electrically isolated from the body of the subcomponent 30*b*, which can be composed of a metal material. The feedthrough conductor 32 has a head 34 at one end and has a pin 38 at another end, which are both exposed to make an electrical interface. The ground ring 36 is electrically isolated from the electrical conductor 32, but the ground ring 36 is in electrical contact with the body of the subcomponent 30*b* for the purposes of grounding.

Figure 5B:
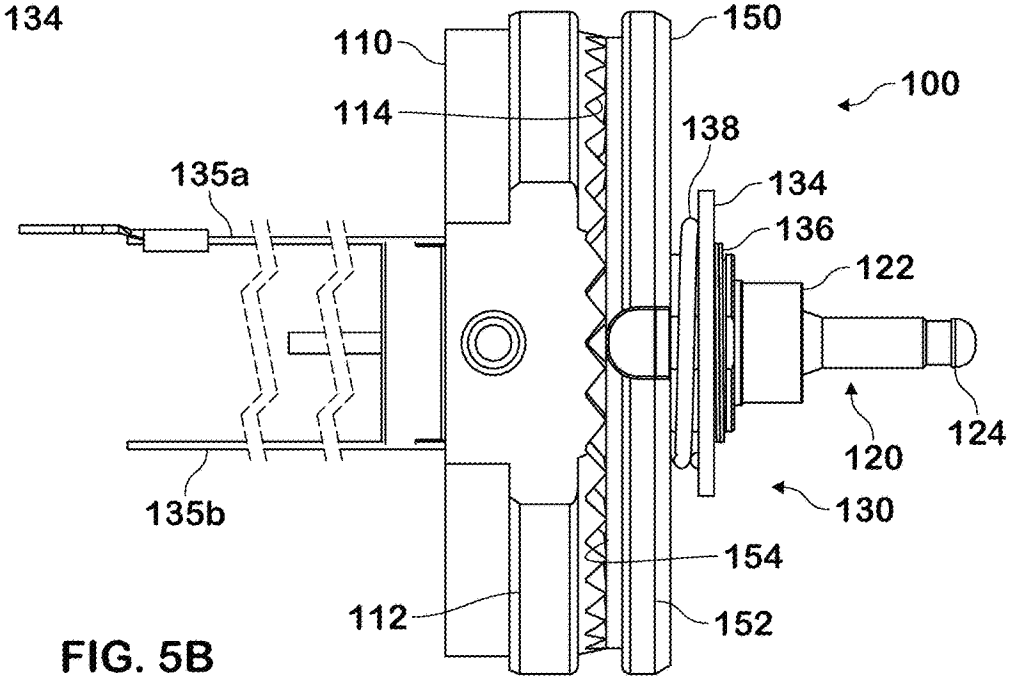
FIG. 5B illustrates a detailed top view of the downhole end fitting.
Figure 5A:
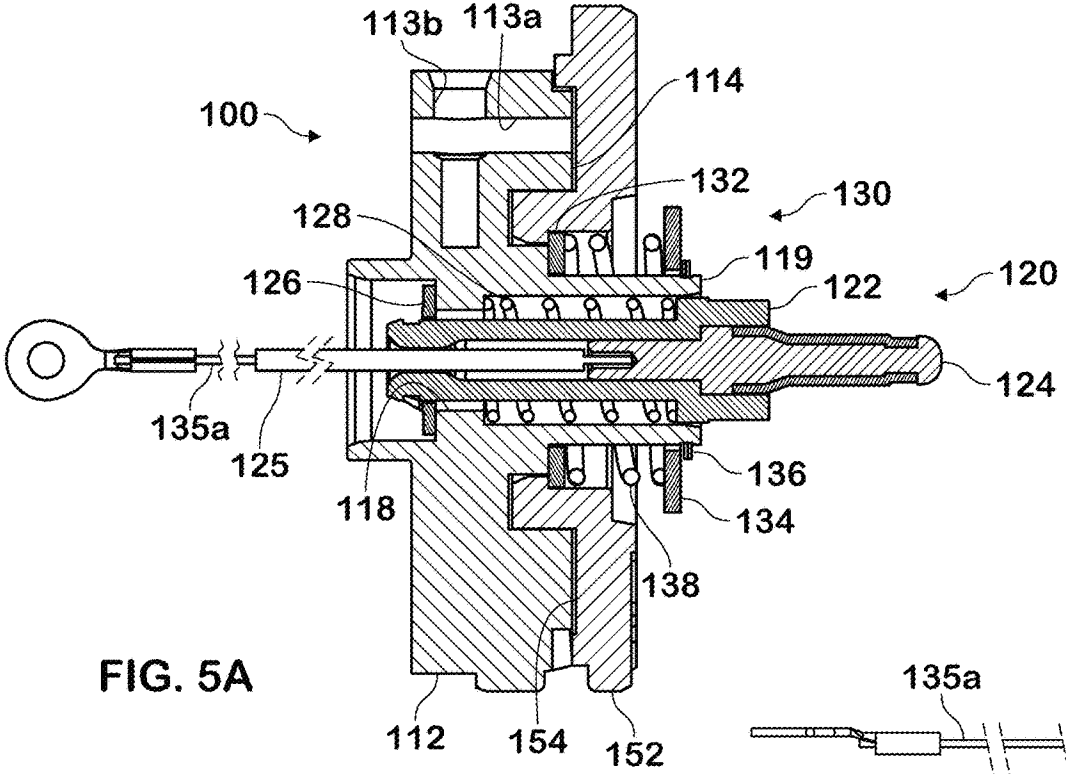
FIG. 5A illustrates a detailed cross-sectional view of a downhole end fitting for the disclosed perforating gun.
Figure 7:
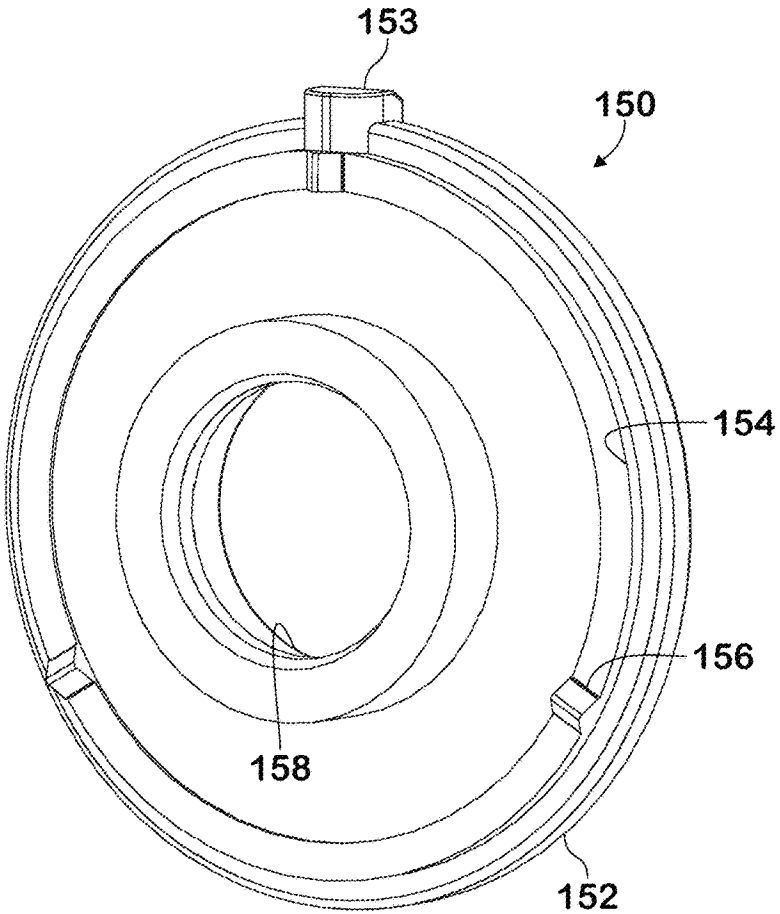
FIG. 7 illustrates a perspective view of an outer support of the downhole end fitting.
Figure 6:
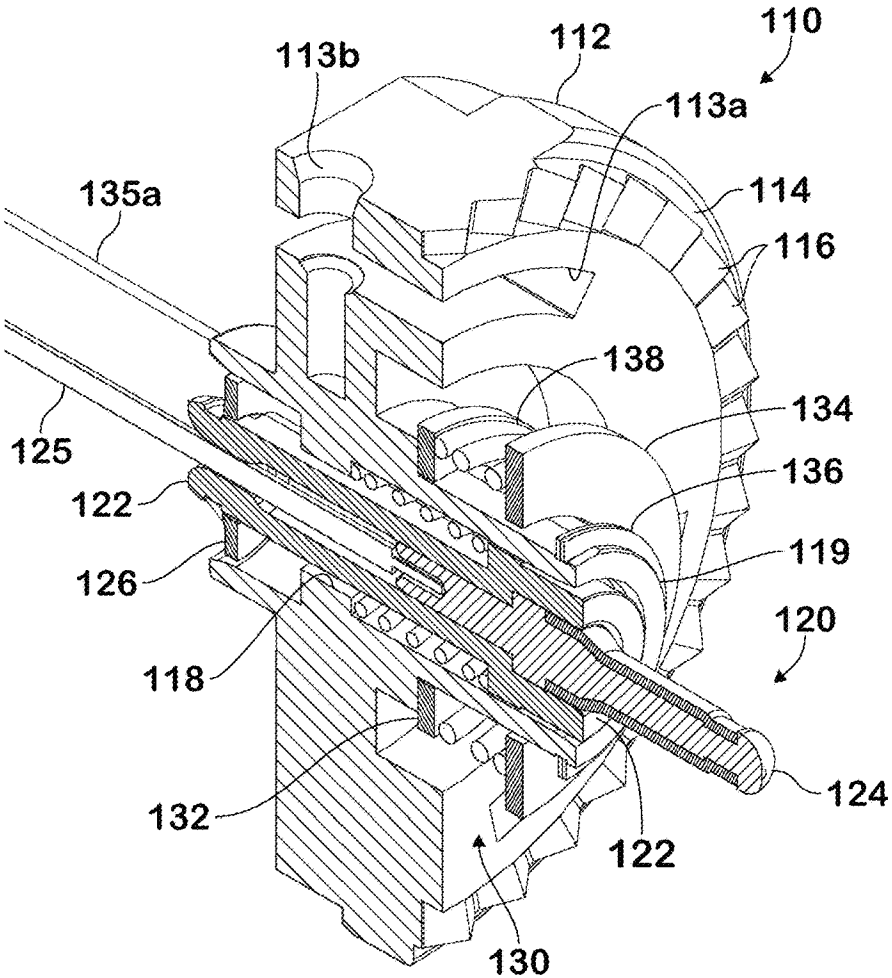
FIG. 6 illustrates a perspective view of an inner support of the downhole end fitting in cross-section.

Looking at the downhole end fitting 100 in more detail, FIG. 5A illustrates a cross-sectional view of the downhole end fitting 100, and FIG. 5B illustrates a top view of the downhole end fitting 100. For additional details, FIG. 6 illustrates a perspective view of the inner support 110 of the downhole end fitting 100 in cross-section, and FIG. 7 illustrates a perspective view of the outer support 150 of the downhole end fitting 100.

As noted, the downhole end fitting 100 has the inner support 110 and outer support 150 that mate with one another. The inner support 110 is affixed to the end (52*b*) of the charge holder (50). For example, the downhole end (52*b*) of the charge holder (50) can engage slots 113*a* and surfaces of the inner support 110, and a fastener (53*b*) can affix the holder's end (52*b*) to the inner support 110 using a fastener opening 113*b*.

The outer support 150 is disposed adjacent to the inner support 110. The outer support 150 has one or more radial projections 153, such as a tab, knob, tooth, etc. on its circumferential edge 152. These one or more radial projections 153 align with and fit into one or more complementary slots (23), grooves, or the like defined on the insider surface of the housing (20) toward its downhole end (22*b*). Therefore, the outer support 150 has a set, fixed, or predetermined radial orientation in the housing (20) in which it positions.

However, the inner support 110 can fit at different radial orientations relative to the adjacent outer support 150. In particular, the inner support 110 has an inner mating surface 114, and the outer support 150 has an outer mating surface 154 that can fit against the inner mating surface 114. The inner and outer mating surfaces 114, 154 have at least one mating feature shared between them. For example, the mating surfaces 116, 156 can each have a respective mating feature configured to mate at different radial orientations of the inner mating surface 114 relative to the outer mating surface 154. When engaged and captured together, the mating features 116, 156 prevent radial rotation of the inner support 110 relative to the outer support 150, which is prevented from rotating by the tab 153 and slot (23) configuration.

The inner support 110 defines a central passage 118 therethrough. The second conductor 120 comprises a holder or sleeve 122, which is disposed in the central passage 118 and which has a proximal end and a distal end. The proximal end has a catch ring or shoulder 126 configured to engage a back surface of the inner support 110. A conductive contact pin 124 is disposed in the sleeve 122 and extends from the distal end of the sleeve 122 for making electrical contact with other components of the gun string. (For example and shown in FIG. 4, the contact pin 124 can engage a contact head (34) of a tandem subcomponent (30*b*) used for the interconnection of the gun's housing 20.) A biasing element 128, such as a compression spring, is disposed between a shoulder of the central opening 118 and a shoulder of the holder or sleeve 122 so that the spring 128 biases the holder or sleeve 122 away from the inner mating surface 114 and extends the contact pin 124 outward from the end fitting 100. A wire or other conductive member 125 connects to the contact pin 124 and extends from the end fitting 100 for connection to the switch assembly (44; FIG. 1B) in the perforating gun (10).

The inner support 110 comprises a central rim 119 extending from the mating surface 114 about the central opening 118. The outer support 150 defines a central opening 158 disposed on this central rim 119 of the inner support 110. For example, the outer support 150 has a disc shape that fits on the central rim 119 that extends from the inner support 110.

The ground conductor 130 of the end fitting 100 has an inner conductive ring 132, an outer conductive ring 134, and a biasing element 138. The inner conductive ring 132 is engaged with at least a portion of a back surface of the outer support 150, and the outer conductive ring 134 is engaged with a portion of the central rim 119 on the inner support 110. For example, the inner ring 132 is engaged with shoulders of the inner and outer supports 110, 150, and the outer ring 134 is retained on the central rim 119 by a retaining clip or other retainer 136 on the central rim 119.

The biasing element 138, which can be a compression spring, is conductive and is biased against the inner and outer conductive rings 132, 134. The spring 138 biases the mating surface 154 of the outer support 150 against the mating surface 114 of the inner support 110. The spring 138 and rings 132, 134 are used for the electrical ground of the electrical connection for the gun (10). Ground wires 135*a-b* or other conductive members connect to the inner ring 132 and extend from the end fitting 100. One ground wire 135*a* can connect to the charge holder (50), while the other ground wire 135 can connect to the switch assembly (44). Additionally, the spring 138 also keeps the inner and outer supports 110, 150 mated together and engaged in a manner that keeps their relative orientation locked during assembly and handling. The biased orientation is then additionally locked in place when the downhole tandem subcomponent 30*b* is assembled on the gun's housing 20.

For example, when the downhole end fitting 100 is disposed adjacent to the tandem subcomponent 30*b* as shown in FIG. 4, a ground ring 36 on the tandem subcomponent 30*b* engages the outer ground ring 134. The spring 138 can be compressed, and the back side of the outer support 150 can have a circumferential cutout to accommodate the ring 134. Electrical grounding is achieved from the ground ring 36, to the outer ring 134, through the spring 138, and to the inner ring 132. In turn, the inner ring 132 can be connected to the ground wires 135*a-b* extending from the inner support 110 to be affixed to components inside the charge holder 50. Meanwhile, a central contact head of the feedthrough conductor 32 on the tandem subcomponent 30*b* as shown in FIG. 4 can engage the biased contact pin 124 extending from the end fitting 100, and the wire 125 connected from the contact pin 124 can connect to the switch assembly (44).

As best shown in FIG. 6, the mating features 116 on the inner mating surface 114 can include a plurality of first teeth 116 disposed radially about the inner mating surface 114. As best shown in FIG. 7, the mating features 156 on the outer mating surface 154 can include a plurality of second teeth 156 disposed radially about the outer mating surface 154 and being complementary to the first teeth 116.

The mating surface 114 of the inner support 110 can have more or fewer features 116 than those features 156 provided on the outer support 150 as long as the features 116, 156 are complementary. The reverse is also possible. In one configuration as just an example, the inner mating surface 114 has a plurality of first teeth 116 arranged at every 10-degrees about the circumference of the inner support 110. By contrast, the outer mating surface 154 has only a few of the second teeth 156 (e.g., three, five, etc.), which are sufficient to engage with the first teeth 116 and prevent radial movement between the inner and outer supports 110, 150.

Other than the radial teeth as shown, various types of mating features can be used between the mating surfaces 114, 154. For example, a mating feature 116 on the inner mating surface 114 can include one or more first interruptions/protrusions/slots disposed radially about inner mating surface 114. Meanwhile, the mating feature 156 on the outer mating surface 154 can include one or more second interruptions/protrusions/slots disposed radially about outer mating surface 154 and being complementary to the first protrusions/slots. Thus, one mating surface can have projecting pins that can be adjustably inserted into different holes disposed about the other mating surface on the supports 110, 150. The mating feature for the mating surfaces 114, 156 can use ratchet, friction, catch, clutch, or other such feature to prevent rotation relative to one another. For example, one mating surface (e.g., 114) can have a friction feature that frictionally engages the other mating surface (e.g., 116) to prevent rotation in clockwise and counterclockwise directions.

In the previous embodiment of the perforating gun 10, interconnecting (a.k.a. tandem or reusable) subcomponents 30*a-b* are configured to thread to internal thread 24 inside the internal passage 25 on the housing's ends 22*a-b* to connect the perforating guns 10 together in a gun string. In alternative configurations, adjacent perforating guns 10 can be directly and releasably interconnected together without the use of any intermediate subcomponents therebetween. For example, the housings 20 of the perforating guns 10 can have tapered box and pin ends configured to thread directly together.

Figure 8:
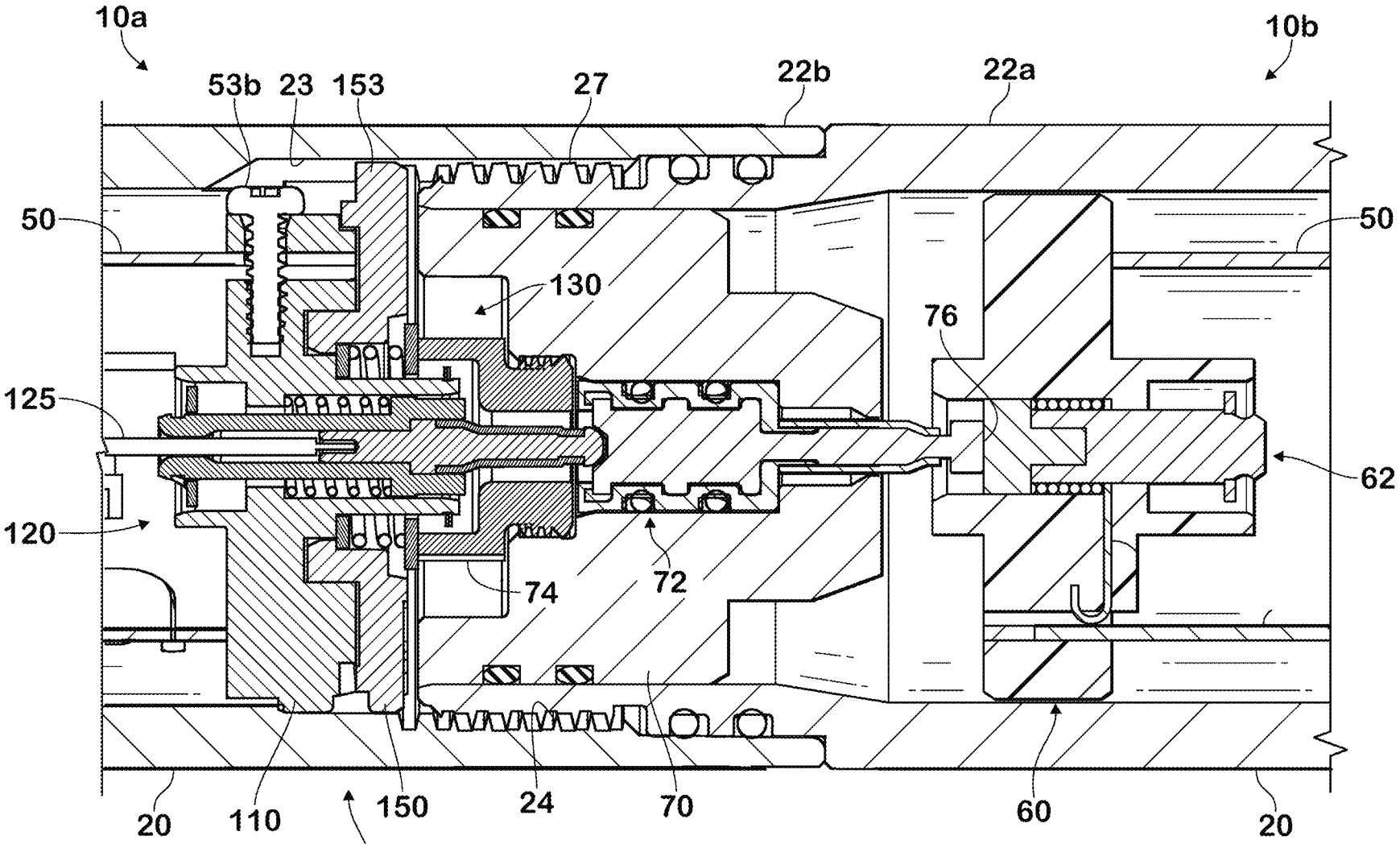
FIG. 8 illustrates a cross-sectional view of perforating guns according to a second embodiment of the present disclosure connected together.

As one example, FIG. 8 illustrates a cross-sectional view of perforating guns 10*a-b* according to a second embodiment of the present disclosure. These perforating guns 10*a-b* are connected together without the use of subcomponents. As shown in FIG. 8, an uphole end 22*a* of the housing 20 (shown here for the downhole gun 10*b*) can include external thread 27, such as on a tapered pin end. Meanwhile, a downhole end 22*b* of the housing 20 (shown here for the uphole gun 10*a*) can include internal thread 24, such as on a tapered box end, configured to thread with the external thread 27 of the downhole perforating gun 10*b*. As before, the second end fitting 100 is disposed in the internal passage 25 toward the downhole end 22*b* of the uphole gun 10*a*.

To complete the electrical interface, a bulkhead 70 is disposed and sealed in the internal passage 25 toward the uphole end 22*a* of the downhole gun 10*b*. The bulkhead 70 has a feedthrough conductor 72 configured to interconnect the conductors 62, 120 of the end fittings 60, 100 on the interconnected guns 10*a-b*. A ground contact 74 on the bulkhead 70, which can be made of conductive material, abuts against the ground conductor 130 on the end fitting 100, which biases the outer support 150 to lock with the inner support 110.

Figure 9:
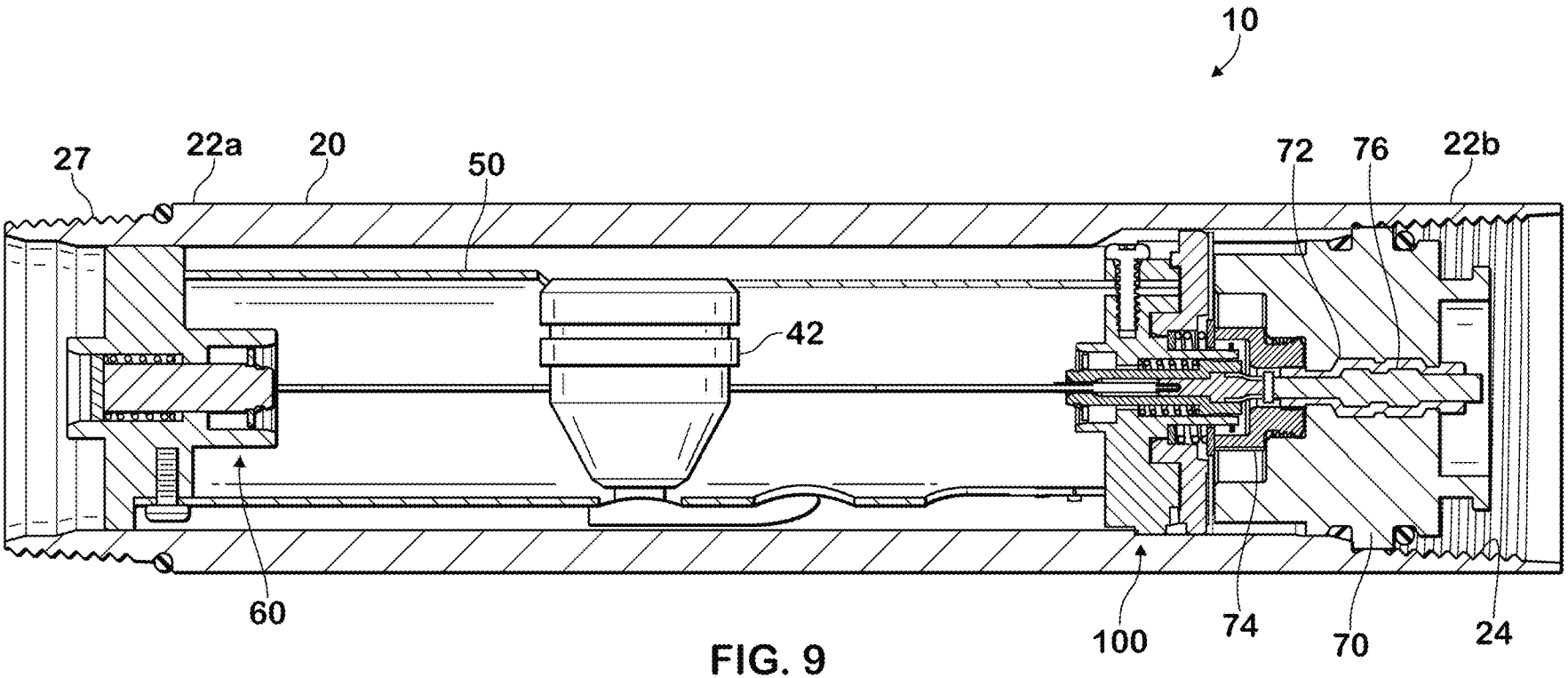
FIG. 9 illustrates a cross-sectional view of a third embodiment of a perforating gun according to the present disclosure.

As another example, FIG. 9 illustrates a cross-sectional view of a third embodiment of a perforating gun 10 according to the present disclosure. This perforating gun 10 is configured to connect to other guns 10 without the use of subcomponents. This is a similar arrangement to that shown in FIG. 8. As before, the uphole end 22*a* can include external thread 27, and the downhole end 22*b* can include internal thread 24. As before, the second end fitting 100 is disposed in the internal passage 25 toward the downhole end 22*b* of the gun 10.

In contrast to the previous arrangement, a bulkhead 70 shown here is disposed in the internal passage 25 toward the downhole end 22*b* of the gun 10. The bulkhead 70 has a feedthrough conductor 72 configured to interconnect the downhole conductor 120 of this perforating gun 10 with the uphole conductor (62) of an interconnected perforating gun (10). A ground contact 74 on the bulkhead 70, which can be made of conductive material, abuts against the ground conductor 130 on the end fitting 100, which biases the outer support 150 to lock with the inner support 110.

Understanding the various components of the perforating gun 10, details regarding its assembly are discussed. Components of the perforating gun 10 are assembled in distinct modules to provide a modular system so the perforating guns 10 can be assembled in a modular fashion to produce a gun string to be run downhole. For example, the gun string can use multiple easily and quickly interconnectable wire-free distinct modules, including, without limitation, tandem subcomponents 30*a-b*, the housings 20, the charge assemblies 40 (having the switch assembly 44, uphole and downhole end fittings 60, 100, and the charge holders 50). The modular gun system can allow quick and easy assembly and arming of each perforating gun 10 and quick and easy disassembly and replacement of any of the modules (e.g., upon component failure). If desired, the perforating gun 10 may be designed not to require any particular tools to assemble each gun 10 or interconnect multiple perforating guns 10 together.

As will be appreciated, the components for the detonator (not shown), detonator chord (not shown), switch assembly 44, and the like are preferably not interconnected until the perforating gun 10 is ready for use. If desired, the perforating gun 10 may be configured so that the switch assembly 44 and other electrical components can be tested without the presence of the detonator, allowing these components to be inspected, tested, and replaced independent of one another.

When ready to assemble for installation downhole, the end fittings 60, 100 can already be affixed to the charge holder 50, and the various components of the charge assembly 40 (e.g., switch assembly 40, detonator, detonator cord, etc.) can be assembled. Before assembling the gun 10 to other guns of the gun string, the orientation of the slot 23 relative to the housing 20 will be known. Additionally, the slot's orientation relative to other guns (10) for the gun string will be known. In this way, when the housing 20 is eventually connected to another gun's housing on the gun string (e.g., connected via a subcomponent 30*b* or connected directly through threaded ends), an indication of the slot's orientation will be understood.

Knowing the details of the relative orientation, the radial orientation of the charge holder 50 and the direction of the shaped charge(s) (42) can be adjusted relative to the tab 153 on the outer support 150 of the downhole end fitting 100. As noted, this can be done by rotating the inner and outer supports 110, 150 relative to one another with the mating surfaces 114, 154. In this way, the resulting direction of the shaped charge(s) (42) of this gun 10 can be configured relative to the direction of shaped charges in the other gun(s) on the gun string once the gun 10 is assembled on the gun string.

In particular, the outer support 150 will fit in the housing 20 at a set alignment due to the orientation of the tab 153 in the slot 23. However, the radial orientation of the inner support 110 (and the connected charge holder 50 and the upper end fitting 60) can be adjusted relative to the outer support 150 so that the orientation of the charges 42 on the holder 50 can be adjusted to a particular orientation relative to the housing 20 when installed therein. Furthermore, by extension the orientation of the charges 42 can be adjusted relative to other guns on the gun string when the gun 10 is installed on the gun string. Accordingly, operators adjust the orientation of the holder 50 as desired by rotating the upper end fitting 60, charge holder 50, and inner support 110 relative to the outer support 150.

Once the orientation is selected, the charge assembly 40 is installed in the housing 20 by fitting the uphole end fitting 60 into the passage 25 through the downhole end 22*b* so the tab 153 on the downhole end fitting 100 locates in the set radial orientation in the slot 23. If the housing 20 of the gun 10 connects directly to other guns on the gun string, then the bulkhead 70 can be installed in the appropriate uphole or downhole end, and the ends of the housing 20 can the threaded direction to other guns of the gun string.

By contrast, if subcomponents 30*a-b* are used, the downhole end 22*b* of the housing 20 is connected to the tandem subcomponent 30*b* on the gun string. The next tandem subcomponent 30*a* is then attached to the housing 20 and fits against the uphole end fitting 60 on the charge holder 50. This captures the charge holder 50 and the end fittings 60, 100 inside the housing's passage 25 between the attached subcomponents 30*a-b*. The mating features, such as the teeth, on the mating surfaces of the inner and outer supports 110, 150 are biased against one another, and rotation of the supports 110, 150 relative to one another is prevented.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A perforating gun, comprising:

a housing defining an internal passage therethrough;

a charge holder having first and second ends and having one or more charge receptacles, the charge holder being configured to position in the internal passage of the housing;

a first end fitting disposed on the first end of the charge holder and disposed inside the housing, the first end fitting being configured to support the first end of the charge holder in the internal passage of the housing, the first end fitting having a first electrical conductor disposed therethrough; and a second end fitting disposed on the second end of the charge holder and disposed inside the housing, the second end fitting having:

a first support disposed on the second end of the charge holder and having a first mating surface, the first support defining a central passage therethrough and comprising a rim extending from the first mating surface about the central passage;

a second electrical conductor disposed through the second end fitting and comprising: a sleeve disposed in the central passage and having a proximal end and a distal end, the proximal end configured to engage a back surface of the first support; a conductive pin disposed in the sleeve and extending from the distal end thereof; and a first biasing element disposed between the sleeve and the first support and biasing the conductive pin away from the first mating surface; and a second support disposed adjacent to the first support and having a second mating surface, the second support defining a central opening disposed on the rim of the first support, the second end fitting comprises a ground conductor having: a first conductive ring configured to engage with a portion of the rim of the first support; a second conductive ring configured to engage with at least a portion of the second support; and a second biasing element being conductive and being biased against the first and second conductive rings, the second support being configured to fit in a set radial orientation relative to the housing and being configured to support the second end of the charge holder in the internal passage of the housing, the first and second mating surfaces having a mating feature configured to mate the first and second mating surfaces at different radial orientations relative to one another.

2. The perforating gun of claim 1, wherein the internal passage of the housing has at least one location; and wherein the second support has at least one locator configured to locate at the at least one location of the internal passage, whereby the second support fits in the set radial orientation relative to the housing.

3. The perforating gun of claim 2, wherein the at least one location comprises a slot defined in the internal passage; and wherein the at least one locator comprises a tab protruding from an edge of the second support and configured to position in the slot.

4. The perforating gun of claim 1, wherein the mating feature comprises:

a first interruption disposed on the first mating surface; and a second interruption disposed on the second mating surface and being complementary to the first interruption.

5. The perforating gun of claim 4, wherein:

the first interruption comprises a plurality of first teeth disposed radially about the first mating surface; and the second interruption comprises a plurality of second teeth disposed radially about the second mating surface and being complementary to the first teeth.

6. The perforating gun of claim 1, wherein at least one first fixture affixes the first end fitting with the first end of the charge holder; and wherein at least one second fixture affixes the first support of the second end fitting with the second end of the charge holder.

7. The perforating gun of claim 1, wherein the housing has one or more scallops defined circumferentially thereabout and being spaced at the one or more charge receptacles.

8. The perforating gun of claim 1, wherein the internal passage of the housing defines internal thread inside opposing ends of the internal passage; and wherein the perforating gun further comprises subcomponents being configured to thread to the internal thread, each subcomponent having an intermediate conductor extending therethrough, each intermediate conductor being configured to electrically connect to a respective one of the first and second electrical conductors.

9. The perforating gun of claim 1, wherein a first opposing end of the housing comprises external thread; and wherein a second opposing end of the housing comprises internal thread configured to thread with the external thread on the housing of another perforating gun, the second end fitting being disposed in the internal passage toward the second opposing end of the housing.

10. The perforating gun of claim 9, wherein the perforating gun further comprises a bulkhead disposed in the internal passage toward the first opposing end, the bulkhead having a feedthrough conductor configured to electrically connect to the first electrical conductor of the first end fitting.

11. The perforating gun of claim 9, wherein the perforating gun further comprises a bulkhead disposed in the internal passage toward the second opposing end, the bulkhead having a feedthrough conductor configured to electrically connect to the second electrical conductor of the second end fitting.

12. A system comprising a plurality of perforating guns interconnected together, each of the perforating guns having a housing defining an internal passage therethrough, each of the perforating guns further having:

a charge holder having first and second ends and having one or more charge receptacles, the charge holder being configured to position in the internal passage of the housing;

a first end fitting disposed on the first end of the charge holder and disposed inside the housing, the first end fitting being configured to support the first end of the charge holder in the internal passage of the housing, the first end fitting having a first electrical conductor disposed therethrough; and a second end fitting disposed on the second end of the charge holder and disposed inside the housing, the second end fitting having:

a first support disposed on the second end of the charge holder and having a first mating surface, the first support defining a central passage therethrough and comprising a rim extending from the first mating surface about the central passage;

a second electrical conductor disposed through the second end fitting and comprising: a sleeve disposed in the central passage and having a proximal end and a distal end, the proximal end configured to engage a back surface of the first support; a conductive pin disposed in the sleeve and extending from the distal end thereof; and a first biasing element disposed between the sleeve and the first support and biasing the conductive pin away from the first mating surface; and a second support disposed adjacent to the first support and having a second mating surface, the second support defining a central opening disposed on the rim of the first support, the second end fitting comprises a ground conductor having: a first conductive ring configured to engage with a portion of the rim of the first support; a second conductive ring configured to engage with at least a portion of the second support; and a second biasing element being conductive and being biased against the first and second conductive rings, the second support being configured to fit in a set radial orientation relative to the housing and being configured to support the second end of the charge holder in the internal passage of the housing, the first and second mating surfaces having a mating feature configured to mate the first and second mating surfaces at different radial orientations relative to one another.

13. A method of assembling the perforating gun according to claim 1 for use on a gun string, the method comprising, not necessarily in sequence:

supporting the first end of the charge holder in the internal passage of the housing using the first end fitting disposed on the first end of the charge holder and disposed inside the housing;

providing a first electrical connection into the housing via the first electrical conductor disposed on the first end fitting;

supporting the second end of the charge holder in the internal passage of the housing using the second end fitting disposed on the second end of the charge holder and disposed inside the housing;

providing a second electrical connection into the housing via the second electrical conductor disposed on the second end fitting;

providing a ground connection into the housing via the ground conductor disposed on the second end fitting;

adjusting a radial orientation of the charge holder relative to the set radial orientation of the second support by rotating the first support relative to the second support; and fixing the adjusted radial orientation of the charge holder by mating the first and second supports together.

14. The method of claim 13, wherein fixing the adjusted radial orientation of the charge holder relative the set radial orientation of the second support by mating the first and second supports together comprises engaging the mating feature between the first and second mating surfaces disposed respectively on the first and second supports.

15. The method of claim 13, further comprising:

affixing a subcomponent to an end of the housing, the subcomponent configured to affix to another component of the gun string; and extending the first electrical connection by engaging a feedthrough conductor on the subcomponent against the first electrical conductor disposed on the first end fitting.

16. The method of claim 13, further comprising:

affixing a subcomponent to an end of the housing, the subcomponent configured to affix to another component of the gun string;

extending the second electrical connection by engaging a feedthrough conductor on the subcomponent against the second electrical conductor disposed on the second end fitting; and forming the ground connection by engaging a portion of the subcomponent against the ground conductor on the second end fitting.

17. The method of claim 13, further comprising:

disposing a bulkhead in an end of the housing, the end of the housing configured to affix to another component of the gun string; and extending the first electrical connection by engaging a feedthrough conductor disposed on the bulkhead against the first electrical conductor on the first end fitting.

18. The method of claim 13, further comprising:

disposing a bulkhead in an end of the housing, the end of the housing configured to affix to another component of the gun string;

extending the second electrical connection by engaging a feedthrough conductor disposed on the bulkhead against the second electrical conductor on the second end fitting; and forming the ground connection by engaging a portion of the bulkhead against the ground conductor disposed on the second end fitting.

19. The method of claim 13, wherein:

providing the first electrical connection into the housing through the first electrical conductor disposed on the first end fitting comprises biasing the first electrical conductor relative to the first end fitting;

providing the second electrical connection into the housing through the second electrical conductor disposed on the second end fitting comprises biasing the second electrical conductor relative to the second end fitting; and providing the ground connection into the housing through the ground conductor disposed on the second end fitting comprises biasing the ground conductor relative to the second end fitting.

20. The method of claim 19, wherein biasing the ground conductor relative to the second end fitting further comprises biasing the first and second supports together.

* * * * *